US008286795B2

(12) United States Patent
Zuk

(10) Patent No.: US 8,286,795 B2
(45) Date of Patent: Oct. 16, 2012

(54) PROCESS OF MAKING A GRAPHIC DECAL FOR A TOOLBOX, DECAL MADE THEREBY, AND KIT OF COMPONENTS

(75) Inventor: Nicholas Joseph Zuk, Howell, MI (US)

(73) Assignee: Steel Skinz LLC, Howell, MI (US)

( * ) Notice: Subject to any disclaimer, the term of this patent is extended or adjusted under 35 U.S.C. 154(b) by 502 days.

(21) Appl. No.: 12/501,429

(22) Filed: Jul. 11, 2009

(65) Prior Publication Data

US 2011/0005946 A1 Jan. 13, 2011

(51) Int. Cl.
*B65D 71/00* (2006.01)

(52) U.S. Cl. ..... 206/575; 206/223

(58) Field of Classification Search ..... 206/223, 206/575, 232, 576, 229, 372, 373; 40/594, 40/913; 428/195.1, 40.1; 156/267, 247, 156/230; 150/154

See application file for complete search history.

(56) References Cited

U.S. PATENT DOCUMENTS

| | | | | |
|---|---|---|---|---|
| 4,153,496 | A | 5/1979 | Swift | |
| 6,059,108 | A * | 5/2000 | Schiltz, Jr. | 206/373 |
| 6,116,906 | A * | 9/2000 | Rifkin | 434/105 |
| 6,318,377 | B1 * | 11/2001 | Folks et al. | 132/73 |
| 2001/0047951 | A1 * | 12/2001 | O'Connor | 206/575 |
| 2005/0022924 | A1 * | 2/2005 | Blackburn | 156/230 |
| 2005/0047589 | A1 * | 3/2005 | Chang | 379/452 |
| 2006/0000788 | A1 * | 1/2006 | Sholem | 211/70.6 |
| 2006/0040081 | A1 * | 2/2006 | Hodsdon et al. | 428/40.1 |
| 2006/0230970 | A1 | 10/2006 | Pimia et al. | |
| 2007/0021068 | A1 * | 1/2007 | Dewhurst | 455/42 |
| 2007/0205118 | A1 * | 9/2007 | Westendorf et al. | 206/229 |
| 2008/0261000 | A1 | 10/2008 | White et al. | |
| 2009/0094868 | A1 * | 4/2009 | Soll et al. | 40/299.01 |
| 2009/0301907 | A1 * | 12/2009 | Mason | 206/223 |
| 2009/0325657 | A1 * | 12/2009 | Ramsdell et al. | 455/575.8 |

* cited by examiner

*Primary Examiner* — Steven A. Reynolds
(74) *Attorney, Agent, or Firm* — Weiner & Burt P.C.; Irving M. Weiner; Pamela S. Burt

(57) ABSTRACT

A process of fabricating an extremely durable graphic decal for a toolbox of a customer, and a kit of components for applying the decal to a toolbox

3 Claims, 3 Drawing Sheets

PROCESS OF MAKING A GRAPHIC DECAL FOR A TOOLBOX, DECAL MADE THEREBY, AND KIT OF COMPONENTS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates generally to a process of fabricating a graphic decal for a toolbox, the decal produced thereby, and a kit of components.

More particularly, the present invention relates to a process of fabricating a graphic peel and stick decal to fit each individual drawer of a toolbox, the decal produced thereby, and a kit of components.

The prior, but not necessarily relevant, art is exemplified by:

Swift U.S. Pat. No. 4,153,496;

Pimia et al. United States Patent Application Publication US 2006/0230970; and

White et al. United States Patent Application Publication US 2008/0261000.

It is a desideratum of the present invention to avoid the animadversions of conventional and present decals, and at the same time to provide unique and easy to apply graphic decals.

SUMMARY OF THE INVENTION

The term "RIP" as used herein means raster image processing [verb] or raster image processor [noun], and is the process and the means of turning vector digital information (such as a PostScript file) into a high-resolution raster image; that is, the RIP takes the digital information about graphics and/or fonts that describes the appearance of a file and translates it into an image composed of individual dots that the imaging device (such as a printer or an imagesetter) can output.

The present invention provides a A process of fabricating a graphic decal for a toolbox of a customer, comprising the steps of: creating a unique graphic design in a computer software program according to dimensions of said toolbox; completing a graphic image from said computer software program; sending said graphic image to said customer for approval; sending said approved graphic image via computer to a raster image processing software computer program; adjusting colors and dimensions of said approved graphic image in said raster image processing software computer program; sending completed data from raster image processing software computer program to a printer; loading into said printer a predetermined adhesive-backed vinyl on which said graphic image is to be printed; when printing of said graphic image is completed, removing said printed graphic image from said printer; laminating said completed printed graphic image with a predetermined laminate on a wide format laminator; placing said laminated printed graphic image on a wide format plotter; die cutting said laminated printed graphic image to a correct size of the customer's toolbox to form a graphic decal; removing from said graphic decal excess material where spaces between toolbox drawers are located; and shipping to said customer a shipping container having therein the completed graphic decal, an instruction sheet for applying said completed graphic decal to said toolbox, and a squeegee for applying said completed graphic decal to said toolbox.

The present invention also provides a graphic decal for a toolbox produced by the process described in the preceding paragraph.

The present invention further provides kit of components for applying a graphic decal to a toolbox of a customer, comprising: a graphic decal for a toolbox produced by the process described hereinabove; a squeegee for applying said graphic decal to said toolbox; a sheet of instructions for applying said graphic decal to said toolbox; and a shipping container containing said graphic decal, said squeegee, and said sheet of instructions.

It is a primary object of the present invention to provide a novel and unique graphic decal for a toolbox as described hereinabove, and methods of fabricating and utilizing same.

A further object is to produce a graphic decal to personalize a toolbox.

Another object of the present invention to provide a process as described hereinabove for producing a peel and stick personalized graphic decal for a toolbox, a kit of components therefor.

Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE INVENTION

Figure 11:
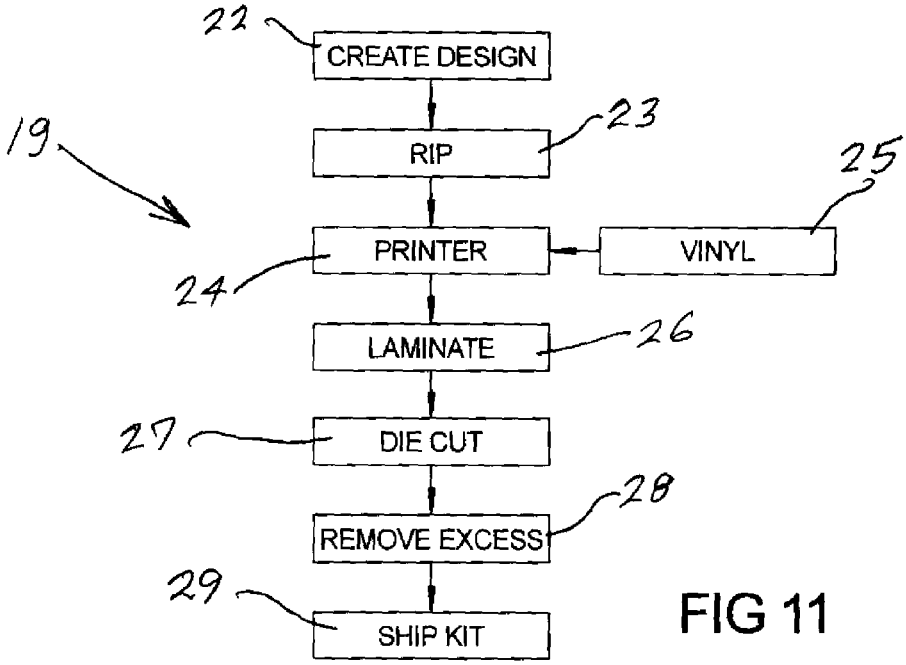
FIG. 11 is a flowchart for the process of the present invention.

With reference to FIG. 11, there is shown a flowchart 19 of the inventive process for fabricating a graphic decal product 20 for a toolbox 21 of a customer The product 20 is created in accordance with the following steps as illustrated in FIG. 11.

The "CREATE DESIGN" box 22 signifies creating a unique graphic design in a computer software program according to the dimensions of the toolbox 21. For example, the graphic design may be created in Adobe Photoshop according to the size of the toolbox 21. If desired, random images along with special effects can be inputted to the file to create an unique design.

The graphic image is completed from said computer software program, and then may be to sent to the customer for approval. The approved graphic image is then sent via computer to a raster image processing software computer program designated by the "RIP" box 23 where colors and sizing of said approved graphic image are adjusted in said raster image processing software computer program.

The completed data from raster image processing software computer program is then sent to a printer designated by the "PRINTER" box 24.

The "VINYL" box 25 signifies the loading into the printer a predetermined adhesive-backed vinyl on which the graphic image is to be printed. When printing of the graphic image is completed, the printed graphic image is removed from the printer.

Preferably, but not necessarily, the vinyl may be 3M IJ180c adhesive-backed vinyl or a similar type The "LAMINATE" box 26 signifies laminating the completed printed graphic image with a predetermined laminate on a wide format laminator.

Preferably, but not necessarily, the laminate may be 3M 3648 Laminate or a similar type.

The "DIE CUT" box 27 signifies placing the laminated printed graphic image on a wide format plotter where the laminated printed graphic image is die cut to a correct size of the customer's toolbox to form a graphic decal.

The "REMOVE EXCESS" box 28 signifies removing from the graphic decal excess material where spaces or gaps 35 between toolbox drawers 34 would be located.

Figure 10:
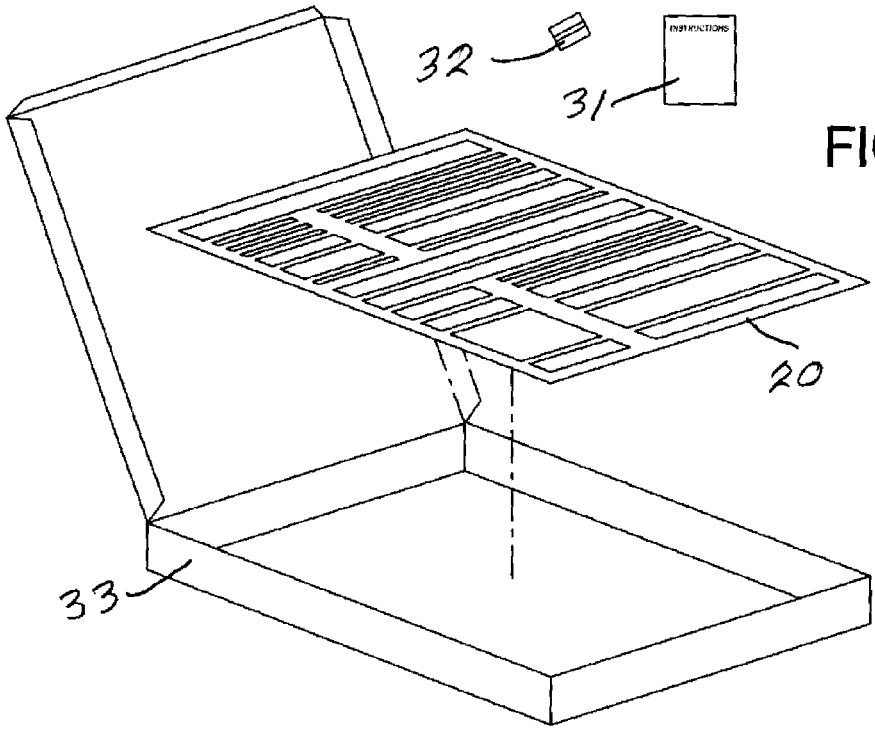
FIG. 10 depicts a kit of components of the present invention.

The "SHIP KIT" box 29 signifies shipping to the customer kit of components 30 (as shown in FIG. 10) comprising a completed graphic decal 20, an instruction sheet 31 for applying the completed graphic decal 20 to the toolbox 21, a squeegee 32 for applying the completed graphic decal 20 to the toolbox 21, and a shipping container 33 for decal 20, instruction sheet 31, and squeegee 32.

Figure 1:
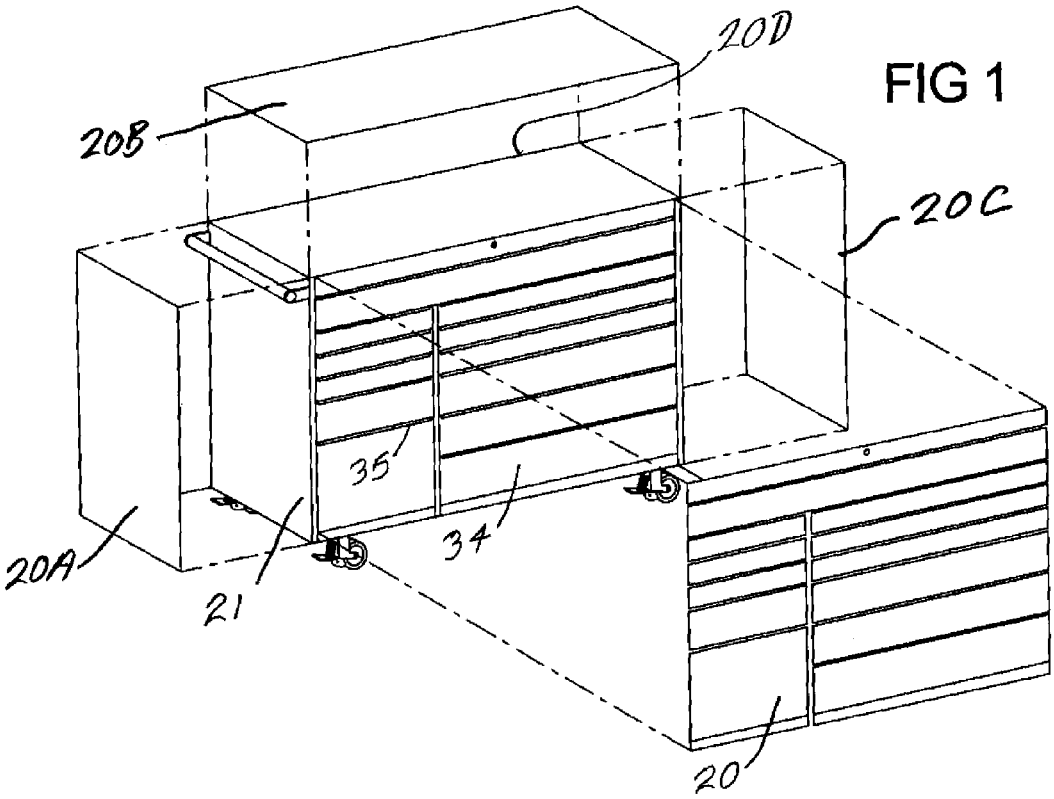
FIG. 1 is a perspective view of the novel graphic decals for a toolbox.

FIG. 1 shows a toolbox 21 with toolbox drawers 34. The decal of the present invention may be applied to one or more surfaces of toolbox 21, as desired. For example, FIG. 1 shows a front decal 20 and optional decals 20A, 20B, 20C and 20D.

Figure 2:
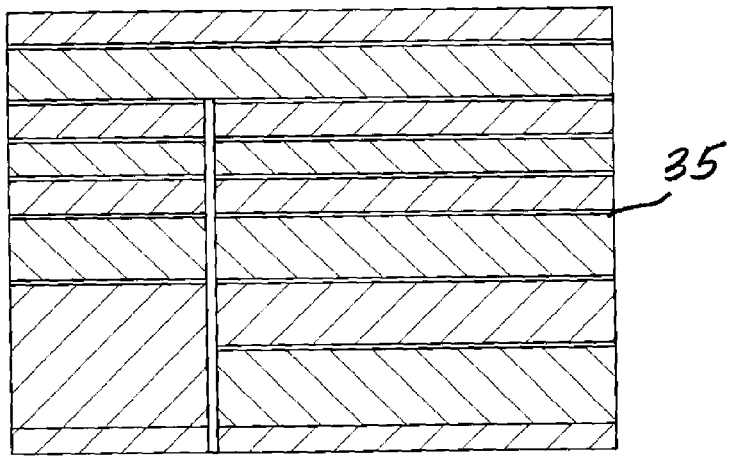
FIG. 2 shows the front decal of FIG. 1.

FIG. 2 shows an enlarged view of the front decal 20 depicting the spaces or gaps 35 located between the toolbox drawers 34.

The instruction sheet 31 for applying decal 20 to the toolbox 21 contains the following application instructions and FIGS. 3-9.

Water is not to be used to apply the decals.

The toolbox surface temperature must be a minimum of 60° F., and must be clean and free of oil, wax, grease, and any foreign matter. DuPont DX330, R&H Pre-Clean, isopropyl alcohol, or any good quality paint prep must be used on the surface prior to installing the decal. After solvent dries, the surface should be wiped dry.

For a neater installation, the handles and emblems should be removed before applying the decal.

For applying small decals, refer to FIGS. 3-6.

Figure 3:
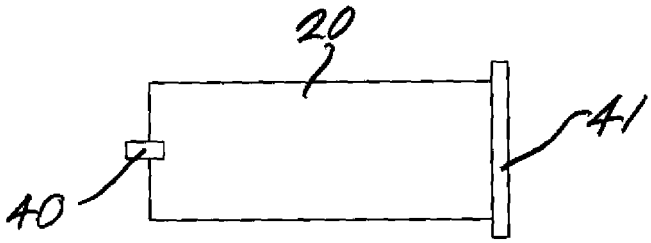
FIGS. 3-9 show the sequence of applying small and large decals.

With reference to FIG. 3, once the small decal is centered, place a piece 40 of positioning masking tape and run a piece 41 of masking tape across the width of the decal, sealing the edge to the toolbox surface.

Figure 4:
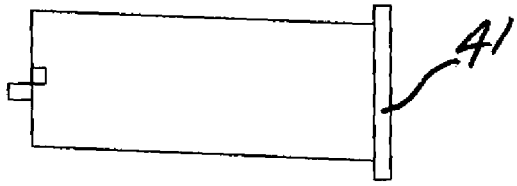

With reference to FIG. 4, tear the positioning tape 40 in half, and flip the decal at the hinge 41.

Figure 5:
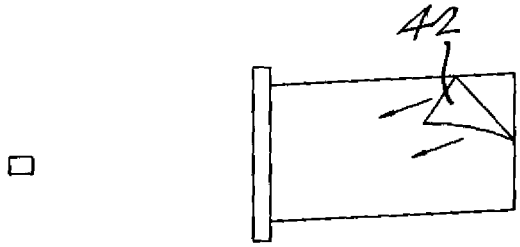

With reference to FIG. 5, with the face of the decal against the toolbox surface, peel the backing paper 42 away from the decal slowly and discard.

Figure 6:
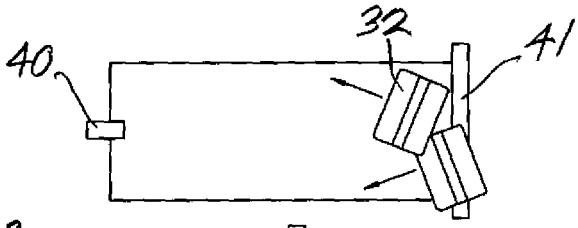

With reference to FIG. 6, flip the decal back down to position, keeping the adhesive slightly off of the toolbox surface to be applied. Align the halves of the positioning tape 40. Starting at the edge of tape hinge 41 and working from the center out squeegee the decal down using firm overlapping strokesin an up-down motion. The squeegee pressure and overlapping strokes should be similar to squeegeeing water off of a glass surface.

Remove the positioning tape 40 and the tape hinge 41.

Figure 7:
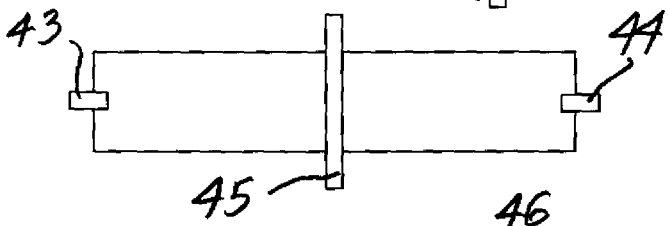
Figure 8:
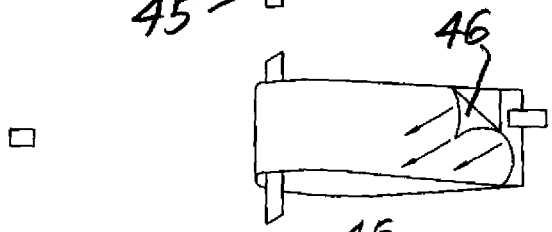
Figure 9:
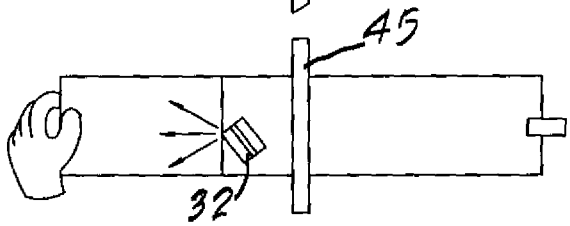

For applying large decals, refer to FIGS. 7-9.

With reference to FIG. 7, place positioning masking tapes 43 and 44, and place a strip 45 of masking tape vertically through the center of the decal exceeding the top and bottom edges by a few inches to form a tape hinge.

With reference to FIG. 8, tear positioning tape 43 in half, and fold one-half of decal away from the application surface. Peel backing paper 46 away from adhesive side of decal up to the tape hinge 45. Do not peel away from backing, only peel backing paper 46 off the decal. Cut backing paper and remove. Do not cut paint on toolbox.

With reference to FIG. 9, fold decal back keeping adhesive slightly off the application surface. Starting at the center of the masking tape hinge 45, sueegee the decal down using firm overlapping strokes, working from the center outwardly. Squeegee pressure and overlaps should be similar to squeegeeing water off of glass.

Remove the masking tape hinge 45, fold opposite half og decal over and remove backing paper. Fold back toward application surface, keeping adhesive slightly off the applixcation surface. Starting at a point where the decal is already down, apply in the same manner as described above.

A decal made as described above and using the 3M products results in a decal with surprising properties. For example, no major failure occurs when: brake fluid is dumped on the decal; it is lit on fire using garage chemicals; acid is put on it; it is sprayed with various automotive chemicals; paint thinner or nail polish or paint remover is poured on it; etc.

Also, automotive polish may be safely used on the decal when it is desired to clean the image.

Any and all changes, modifications, variations and other uses and applications of the present invention which do not depart from the spirit and scope of the present invention are covered by and embraced within the present invention and the patent claims set forth hereinbelow.

The invention claimed is:

1. The combination of a toolbox and a kit of components for applying a personalized graphic decal product to the toolbox, wherein:

said toolbox has a front surface, a rear surface, a right side surface, a left side surface, a top surface, a bottom surface, toolbox drawers, and gaps between said toolbox drawers;

said kit comprising:

a personalized graphic decal product produced by creating a unique graphic design in a computer software program according to the size of said toolbox; completing a graphic image from said computer software program; sending said graphic image to the customer for approval; sending the approved graphic image via computer to a raster image processing software computer program; adjusting colors and sizing of said approved graphic image in said raster image processing software computer program; sending completed data from said raster image processing software computer program to a color solvent digital printer; loading into said color solvent digital printer a predetermined adhesive-backed vinyl on which said graphic image is to be printed; when printing of said graphic image is completed, removing said printed graphic image from said color solvent digital printer; laminating said completed printed graphic image with a predetermined laminate on a wide format laminator; placing said laminated printed graphic image on a wide format plotter; die cutting said laminated printed graphic image to a correct size of said toolbox to form a personalized graphic decal; and removing from said personalized graphic decal excess material where said gaps between said toolbox drawers would be;

said personalized graphic decal product being dimensioned and shaped to completely cover said front surface of said toolbox and front surfaces of said toolbox drawers when applied thereto;

a squeegee for applying said personalized graphic decal product to said front surface of said toolbox and said front surfaces of said toolbox drawers of said toolbox; and a sheet of instructions for applying said personalized graphic decal product to said front surface of said toolbox and said front surfaces of said toolbox drawers of said toolbox.

2. The combination of a toolbox and a kit of components for applying a personalized graphic decal product to the toolbox, wherein:

said toolbox having a front surface, a rear surface, a right side surface, a left side surface, a top surface, a bottom surface, toolbox drawers, and gaps between said toolbox drawers;

said kit comprising:

a personalized graphic decal product produced by creating a unique graphic design in a computer software program according to the size of said toolbox; completing a graphic image from said computer software program; sending said graphic image to the customer for approval; sending the approved graphic image via computer to a raster image processing software computer program; adjusting colors and sizing of said approved graphic image in said raster image processing software computer program; sending completed data from said raster image processing software computer program to a color solvent digital printer; loading into said color solvent digital printer a predetermined adhesive-backed vinyl on which said graphic image is to be printed; when printing of said graphic image is completed, removing said printed graphic image from said color solvent digital printer; laminating said completed printed graphic image with a predetermined laminate on a wide format laminator; placing said laminated printed graphic image on a wide format plotter; die cutting said laminated printed graphic image to a correct size of said toolbox to form a personalized graphic decal; and removing from said personalized graphic decal excess material where said gaps between said toolbox drawers would be;

said color solvent digital printer comprises a six-color solvent Wide Format Digital printer;

said predetermined adhesive-backed vinyl comprises 3M IJ180c adhesive-backed 2 mil cast vinyl;

said predetermined laminate comprises 3M 3648 sidewalk over laminate;

said personalized graphic decal product being of the correct size of said toolbox, and wherein said personalized graphic decal product has removed therefrom excess material where said gaps between said toolbox drawers of said toolbox would be;

said personalized graphic decal product being dimensioned and shaped to completely cover said front surface of said toolbox and front surfaces of said toolbox drawers when applied thereto;

a squeegee for applying said personalized graphic decal product to said front surface of said toolbox and said front surfaces of said toolbox drawers of said toolbox; and a sheet of instructions for applying said personalized graphic decal product to said front surface of said toolbox and said front surfaces of said toolbox drawers of said toolbox.

3. The combination of a toolbox and a kit of components for applying a personalized graphic decal product to a toolbox, wherein:

said toolbox having a front surface, a rear surface, a right side surface, a left side surface, a top surface, a bottom surface, toolbox drawers, and gaps between said toolbox drawers;

said kit comprising:

a personalized graphic decal product produced by creating a unique graphic design in a computer software program according to the size of said toolbox; completing a graphic image from said computer software program; sending said graphic image to the customer for approval; sending the approved graphic image via computer to a raster image processing software computer program; adjusting colors and sizing of said approved graphic image in said raster image processing software computer program; sending completed data from said raster image processing software computer program to a color solvent digital printer; loading into said color solvent digital printer a predetermined adhesive-backed vinyl on which said graphic image is to be printed; when printing of said graphic image is completed, removing said printed graphic image from said color solvent digital printer; laminating said completed printed graphic image with a predetermined laminate on a wide format laminator; placing said laminated printed graphic image on a wide format plotter; die cutting said laminated printed graphic image to a correct size of said toolbox to form a personalized graphic decal; and removing from said personalized graphic decal excess material where said gaps between said toolbox drawers would be;

said computer software program comprises Adobe Photoshop;

said color solvent digital printer comprises a six-color solvent Wide Format Digital printer;

said predetermined adhesive-backed vinyl comprises 3M IJ180c adhesive-backed 2 mil cast vinyl;

said predetermined laminate comprises 3M 3648 sidewalk over laminate;

said personalized graphic decal product being dimensioned and shaped to completely cover said front surface of said toolbox and front surfaces of said toolbox drawers when applied thereto;

a squeegee for applying said personalized graphic decal product to said front surface of said toolbox and said front surfaces of said toolbox drawers of said toolbox; and a sheet of instructions for applying said personalized graphic decal product to said front surface of said toolbox and said front surfaces of said toolbox drawers of said toolbox.

* * * * *